United States Patent [19]

Fujii et al.

[11] Patent Number: 5,033,892

[45] Date of Patent: Jul. 23, 1991

[54] PRINTER CASE

[75] Inventors: Kiyoshi Fujii; Kenichi Tsumuraya, both of Tokyo, Japan

[73] Assignee: Seikosha Co., Ltd., Tokyo, Japan

[21] Appl. No.: 484,026

[22] Filed: Feb. 23, 1990

[30] Foreign Application Priority Data

Feb. 23, 1989 [JP] Japan ..... 1-20681[U]

[51] Int. Cl.[5] ..... B41J 29/02

[52] U.S. Cl. ..... 400/692; 400/689; 400/691; 181/200

[58] Field of Search ..... 400/691, 692, 693, 689, 400/690; 181/198, 200, 201

[56] References Cited

U.S. PATENT DOCUMENTS

| | | | |
|---|---|---|---|
| 4,502,804 | 3/1985 | Willcox | 400/690 |
| 4,526,489 | 7/1985 | Tsumuraya et al. | 400/693 |
| 4,747,717 | 5/1988 | Anderson | 400/689 |
| 4,828,417 | 5/1989 | Tano et al. | 400/693 |

FOREIGN PATENT DOCUMENTS

| | | | |
|---|---|---|---|
| 46282 | 3/1985 | Japan | 400/690 |
| 73881 | 4/1985 | Japan | 400/689 |
| 32064 | 2/1987 | Japan | 400/689 |

*Primary Examiner*—Edgar S. Burr
*Assistant Examiner*—Ren Yan
*Attorney, Agent, or Firm*—Jordan and Hamburg

[57] ABSTRACT

A printer case permits paper to be placed in a printer or the ink ribbon to be replaced without the need to remove the cover or the paper shelf. The case comprises a cover mounted on the upper surface of the case and a paper shelf mounted so as to be swingable about its rear end. Projection portions are formed at opposite sides of the upper surface of the shelf. The cover is swingable about its rear end and an opening having a given width is formed between the rear end of the shelf and the front end of the cover such that when the cover and the shelf are opened, the projection portions engage the front end of the cover to maintain the cover and the shelf in an open state.

14 Claims, 1 Drawing Sheet

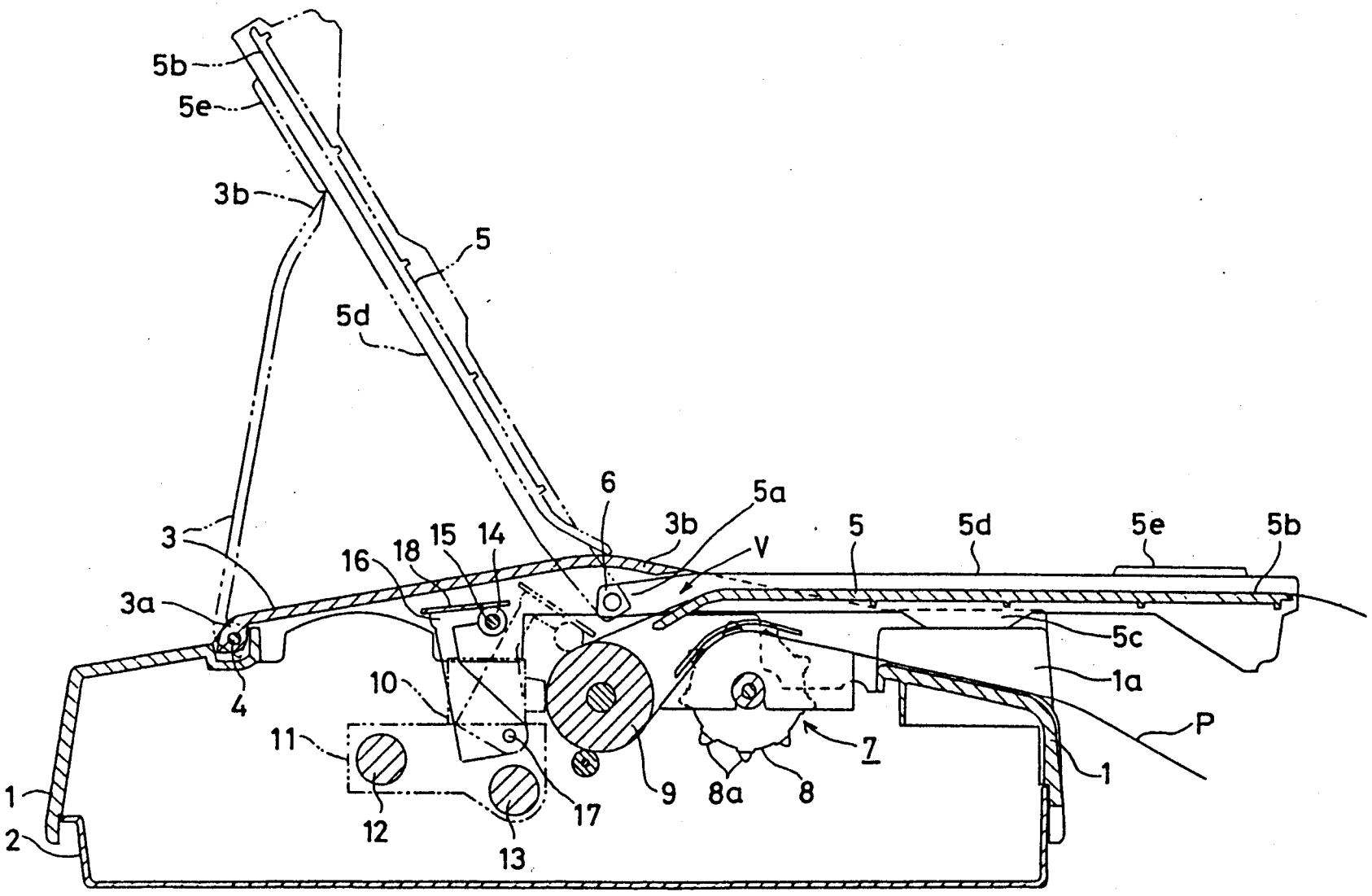
5b
5e
5d
5
5a
V
3b
6
5
5d
3b
5e
5b
5c
1a
P
1
7
8
8a
9
17
13
14
15
18
16
10
12
11
4
3
3a
1
2

PRINTER CASE

FIELD OF THE INVENTION:

The present invention relates to a printer case.

BACKGROUND OF THE INVENTION:

Generally, a printer is equipped with a paper shelf to prevent printed paper delivered from the printer from making contact with unprinted paper fed into the printer. Therefore, when a roll of paper is placed in position inside the printer, the cover of the case is first removed to widely open the upper portion. The paper shelf is then removed and the roll of paper is passed under the shelf and set on the tractor. Also, when the ink ribbon is replaced, the replacement operation is carried out after the cover is removed.

In the above-described prior art arrangement, whenever paper is placed in position or the ink ribbon is replaced, the cover or the paper shelf must be removed and this results in an inconvenience. Also, the space in which the removed cover or paper shelf is temporarily placed is needed In addition, when the cover or the shelf has been removed, there is a danger that it may be damaged.

SUMMARY OF THE INVENTION:

It is an object of the present invention to provide a printer case which permits paper to be set and the ink ribbon to be replaced without the need to remove the cover or the paper shelf, facilitates such setting and replacement operations, does not require extra space, and eliminates the possibility of damage to the cover and the paper shelf.

The above object is achieved by a printer case comprising a cover which is provided at the upper surface of a printer case and which is swingable about the side of the rear end portion of the printer case, a paper shelf whose rear end portion is so positioned that an opening having a given width is formed between the rear end portion of the shelf and the front end portion of the cover, the shelf being mounted so as to be swingable about the sides of the rear end portion of the printer case, and projection portions which are formed at opposite sides of the upper surface of the shelf and which, when the cover and the shelf are opened, engage the front end portion of the cover to maintain the cover and the shelf in an open state.

BRIEF DESCRIPTION OF THE DRAWING:

The drawing is a cross-sectional view of a printer case according to the invention.

DESCRIPTION OF THE PREFERRED EMBODIMENTS:

Referring to the drawing, there is shown a printer case according to the invention. The case includes an upper case 1 and a lower case 2 disposed opposite to the upper case 1. A cover 3 is mounted on the upper surface of the upper case 1 and has a rear end portion 3*a* and a front end portion 3*b*. The cover 3 can swing about a shaft 4 extending through the rear end portion 3*a*.

A paper shelf 5 is mounted on the side of the front end portion 3*b* of the cover 3 and has a rear end portion 5*a*. The shelf 5 can swing about a shaft 6 extending through the rear end portion 5*a*. A gap V of a given width is formed between the front end portion 3*b* of the cover and the rear end portion 5*a* of the shelf. A pair of supporting protrusions 5*c* extend downwardly from either side of the lower surface of the paper shelf 5. A pair of receiver portions 1*a* protrude from either side of the upper surface of the upper case 1. The protrusions 5*c* bear on the receiver portions 1*a*, respectively. A paper-conveying surface is formed on the shelf 5 and terminates at its front end portion 5*b*. This paper-conveying surface is held horizontal. Side walls 5*d* acting to guide paper are formed at opposite sides of the upper surface of the shelf 5. Projection portions 5*e* are formed on the side walls 5*d* at the front end portion 5*b*. When the cover 3 and the shelf 5 are opened, the projection portions 5*e* engage the front end portion 3*b* of the cover to maintain the cover 3 and the shelf 5 open, as shown by broken lines in the drawing.

The recording paper P having perforations moves on the upper surface of the upper case 1 between the pair of receiver portions 1*a* and under the paper shelf 5. The perforations engage pins 8*a* of pin wheels 8 of a tractor 7. The paper moves around the outer periphery of a platen 9 and is guided onto the upper surface of the paper shelf 5 through the opening V. A print head 10 is disposed opposite to the platen 9 and carried on a carriage 11. The head 10 moves axially of the platen 9 while guided by guide shafts 12 and 13 to print characters on the paper P.

Operable means include a pinch roller 14 having a shaft 15 which is mounted in the printer case and which can be pressed against, or separated from, the platen 9. The overall means also includes a pair or levers 16 which support the opposite ends of the shaft 15. The levers 16 are held so as to be swingable about shafts 17. As the levers 16 move angularly, the pinch rollers 14 can bear against the platen 9 to press the paper P against the platen 9. The operating means also includes shield plates 18 mounted on the top of the levers 16. When the pinch roller 14 presses the paper P against the platen 9 to print characters, the shield plates 18 cover the opening V between the cover 3 and the paper shelf 5 to prevent noise produced by printing from passing out.

In this structure, when the recording paper P is placed in the printer or an ink ribbon is placed on the print head, the front end portion 5*b* of the paper shelf 5 is raised and swings in a counterclockwise direction about the shaft 6. During this swinging movement, the front end portion 3*b* of the cover comes into contact with the side walls 5*d*, raising the cover 3. The cover 3 is thereby moved angularly in a counterclockwise direction about the shaft 4. When the shelf 5 swings to such an extent that it is fully open as indicated by the broken lines in the drawing, the front end portion 3*b* of the cover 3 engages the projection portions 5*e* of the shelf 5 such that the front end portion 3*b* and each projection portion 5*e* support each other the open state being self-maintained when the operator's hand is taken away. After the recording paper P is placed in the printer or other operations are completed, the front end portion 5*b* of the paper shelf 5 is again gripped and angularly moved in the opposite or clockwise direction. Also, the cover 3 angularly moves in the opposite or clockwise direction while its front end portion 3*b* slides on the side wall 5*d*. The cover 3 and the paper shelf 5 are returned to the original position indicated by solid lines in the drawing.

In the novel printer case constructed as described above, by angularly moving the paper shelf, the cover moves angularly together with the shelf, so that they are opened and closed together. Hence, unlike the prior art printer case, it is not necessary to remove the cover and the paper shelf. This makes it easy to set the paper and to replace the ink ribbon. Further, space for accommodating the cover and the shelf is dispensed with. In addition, there is no danger of damage to the cover and to the paper shelf.

Although the present invention has been described in specific terms, it should be noted here that the described embodiments are not necessarily exclusive and that various changes and modifications may be imparted thereto without departing from the scope of the invention, which is limited solely by the appended claims.

What we claim is:

1. A printer case comprising a casing means having an upper part, a cover having a front end portion and a rear end portion, first pivotal means pivotably mounting said rear end portion of said cover on said upper part of said casing means, a paper shelf having a front end portion and a rear end portion, second pivotal means pivotably mounting said rear end portion of said paper shelf on said upper part of said casing means, said cover and said paper shelf having a pivotal closed position in which said rear end portion of said paper shelf and said front end portion of said cover define a paper opening therebetween, said cover and said paper shelf having a pivotal open position pivotably displaced from said pivotal closed position, engageable means on said paper shelf and on said cover engageable with each other to maintain said paper shelf and said cover in said pivotal open position, said front end portion of said cover overlying said rear end portion of said paper shelf when said cover and said paper shelf are in said pivotal closed position, said paper shelf upon being pivoted from its pivotal closed position to its pivotal open position being operable to engage said front end portion of said cover and effect pivoting of said cover from its pivotal closed position to its pivotal open position responsive to movement of said paper shelf from said closed position to said open position.

2. A printer case according to claim 1, wherein said upper part of said casing means has a frontal section, said paper shelf overlying said frontal section when said paper shelf is in said pivotal closed position, said paper shelf being displaced from overlying said frontal section when in said pivotal open position.

3. A printer case according to claim 2, wherein said upper part of said casing means has an access section juxtaposed to said frontal section, said cover overlying said access section when said cover is in said pivotal closed position, said cover being displaced from overlying said access section when in said pivotal open position to thereby provide access to said access section.

4. A printer case according to claim 1, wherein said paper shelf has side walls which engage said front end portion of said cover when said paper shelf is pivoted from its pivotal closed position to its pivotal open position.

5. A printer case according to claim 1, wherein said side walls have a forward section, and projections on said forward section of said side walls being operable to engage said front end portion of said cover after said paper shelf and said cover have been pivoted to their pivotal open position to thereby retain said paper shelf and said cover in said pivotal open position.

6. A printer case according to claim 1, further comprising a platen rotatably mounted on said casing means, and paper guide means underlying said paper shelf when said paper shelf is in said pivotal closed position for guiding paper to said platen.

7. A printer case according to claim 6, wherein said platen is juxtaposed to said paper opening such that said paper passes from said platen to said paper opening.

8. A printer case according to claim 6, further comprising a print head mounted on said casing means, said print head and said platen generally underlying said cover when said cover is in said pivotal closed position,

9. A printer case according to claim 1, wherein said casing means has support means engageable by said paper shelf when said paper shelf is in said pivotal closed position, said support means underlying said paper shelf when said paper shelf is in said pivotal closed position.

10. A printer case according to claim 1, wherein said cover has a front terminating end, said paper shelf having a rear terminating end, said front and rear terminating ends being spaced from one another to define said paper opening.

11. A printer case according to claim 10, wherein said front terminating end of said cover overlies said rear terminating end of said paper shelf when said cover and said paper shelf are in said pivotal closed position.

12. A printer case according to claim 1, further comprising operable means pivotably mounted on said casing means and pivotal between first and second positions, said operable means when in said first position being disposed to cover said paper opening.

13. A printer case according to claim 12, wherein said operable means comprises a shield plate disposed to cover said paper opening when said operable means is in said first position.

14. A printer case according to claim 12, further comprising a platen rotatably mounted on said casing means, said operable means comprising pinch roller means engageable with said platen when said pivot means is in said first position.

* * * * *